US010794236B2

(12) United States Patent
Kawahara et al.

(10) Patent No.: US 10,794,236 B2
(45) Date of Patent: Oct. 6, 2020

(54) TAPPET

(71) Applicants: OTICS CORPORATION, Nishio-shi, Aichi (JP); KUBOTA CORPORATION, Osaka-shi, Osaka (JP)

(72) Inventors: Kazunori Kawahara, Nishio (JP); Masayasu Takami, Sakai (JP)

(73) Assignees: OTICS CORPORATION, Nishio-Shi, Aichi (JP); KUBOTA CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 16/483,117

(22) PCT Filed: Jan. 26, 2018

(86) PCT No.: PCT/JP2018/002423
§ 371 (c)(1),
(2) Date: Aug. 2, 2019

(87) PCT Pub. No.: WO2018/150847
PCT Pub. Date: Aug. 23, 2018

(65) Prior Publication Data

US 2020/0232351 A1 Jul. 23, 2020

(30) Foreign Application Priority Data

Feb. 17, 2017 (JP) ..... 2017-027503

(51) Int. Cl.
*F01L 1/18* (2006.01)
*F01L 1/245* (2006.01)
(Continued)

(52) U.S. Cl.
CPC ..... *F01L 1/245* (2013.01); *F01L 1/047* (2013.01); *F01L 1/146* (2013.01); *F01L 1/181* (2013.01);
(Continued)

(58) Field of Classification Search
CPC . F01L 1/245; F01L 1/047; F01L 1/146; F01L 1/181; F01L 2001/2427;
(Continued)

(56) References Cited

U.S. PATENT DOCUMENTS

2007/0119397 A1* 5/2007 Diggs ..... F01L 1/182 123/90.4
2013/0306015 A1 11/2013 Kawahara
2016/0376936 A1 12/2016 Kubota

FOREIGN PATENT DOCUMENTS

JP 60-170008 U 11/1985
JP 10-169415 A 6/1998
(Continued)

OTHER PUBLICATIONS

International Search Report for PCT/JP2018/002423, dated Mar. 6, 2018 in English and Japanese Language (4 pgs.).

*Primary Examiner* — Zelalem Eshete
(74) *Attorney, Agent, or Firm* — Smith, Gambrell & Russell, LLP

(57) ABSTRACT

In a tappet with a built-in lash adjuster, hydraulic oil is prevented from leaking from a low pressure chamber during a long-period stop.
A tappet (10) includes a hydraulic lash adjuster (11) which supports a lower end portion of a push rod (96) and a tappet case (12) to which the lash adjuster (11) is internally fitted and which is reciprocally displaced in a vertical direction according to a rotating cam (85). An inner peripheral surface of the tappet case (12) is provided with an air-vent passage (34) through which air existing between the tappet case (12)
(Continued)

and the lash adjuster (11) can be discharged upward when the lash adjuster (11) is being assembled.

20 Claims, 7 Drawing Sheets

(51) Int. Cl.

| | |
|---|---|
| ***F01L 1/047*** | (2006.01) |
| ***F01L 1/14*** | (2006.01) |
| ***F01M 9/10*** | (2006.01) |
| *F01L 1/24* | (2006.01) |

(52) U.S. Cl.
CPC ..... *F01M 9/101* (2013.01); *F01M 9/104* (2013.01); *F01L 2001/2427* (2013.01); *F01L 2001/2444* (2013.01); *F01L 2001/256* (2013.01)

(58) Field of Classification Search
CPC ..... F01L 2001/2444; F01L 2001/256; F01M 9/101; F01M 9/104
See application file for complete search history.

(56) References Cited

FOREIGN PATENT DOCUMENTS

| | | | |
|---|---|---|---|
| JP | 2004-36476 | A | 2/2004 |
| JP | 2008-232125 | A | 10/2008 |
| JP | 2010-261357 | A | 11/2010 |
| JP | 2013-241861 | A | 12/2013 |
| WO | 2015/107937 | A1 | 7/2015 |

* cited by examiner

TAPPET

TECHNICAL FIELD

The present invention relates to a tappet.

BACKGROUND ART

Patent Literature 1 discloses a tappet configured as a valve lifter. The tappet has a cup-like shape, and a lower end portion of a push rod abuts and is supported on an inner bottom portion of the tappet. An upper end portion of the push rod supports one end of a rocker arm. The other end of the rocker arm abuts on an upper end portion of an exhaust valve.

A lower surface of the tappet is a flat sliding contact surface and is in contact with a cam. When the cam rotates, the tappet is raised and lowered in a cylinder bore together with the push rod, and accordingly, the rocker arm swings to open and close the valve.

CITATIONS LIST

Patent Literature

Patent Literature 1: JP-A-10-169415

SUMMARY OF INVENTION

Technical Problems

There has been known a configuration in which the tappet does not directly support the push rod but a hydraulic lash adjuster is incorporated in the tappet and a top portion of the lash adjuster abuts against the lower end portion of the push rod so that the tappet indirectly supports the push rod via the lash adjuster. According to this configuration, a position of a swing fulcrum of the rocker arm can be properly adjusted by the hydraulic pressure of the lash adjuster, so that valve clearance can be eliminated.

When the lash adjuster is incorporated into the tappet, it is necessary to remove the air enclosed between the lash adjuster and the tappet. In this case, if an air-vent passage is provided in a lower end portion of a peripheral wall of the tappet so as to be opened laterally, hydraulic oil stored in a low pressure chamber of the lash adjuster may be discharged to the outside through the air-vent passage when an internal combustion engine is stopped for a long period of time, so that an amount of the hydraulic oil in the low pressure chamber may be significantly reduced. As a result, so-called air entrainment where the air in the low pressure chamber transfers to a high pressure chamber may occur at the time of restart of engine, so that a countermeasure therefor is desired.

The present invention has been completed based on the above circumstances, and its purpose is to provide a tappet with a built-in lash adjuster, in which hydraulic oil is prevented from leaking from a low pressure chamber during a long-period stop.

Solutions to Problems

A tappet of the present invention includes a hydraulic lash adjuster which supports a lower end portion of a push rod and a tappet case to which the lash adjuster is internally fitted and which is reciprocally displaced in a vertical direction according to a rotating can. In the tappet, an inner peripheral surface of the tappet case is provided with an air-vent passage through which air existing between the tappet case and the lash adjuster is discharged upward when the lash adjuster is being assembled.

Advantageous Effects of Invention

When the hydraulic lash adjuster is incorporated into the tappet case, the air existing between the tappet case and the lash adjuster is discharged upward through the air-vent passage. Since the air-vent passage is opened upward (including obliquely upward), the hydraulic oil stored in the low pressure chamber (reservoir chamber) of the lash adjuster can be prevented from leaking through the air-vent passage when the internal combustion engine is stopped for a long period of time. As a result, it is possible to avoid air entrainment to the high pressure chamber at the time of restart.

DESCRIPTION OF EMBODIMENTS

Figure 1:
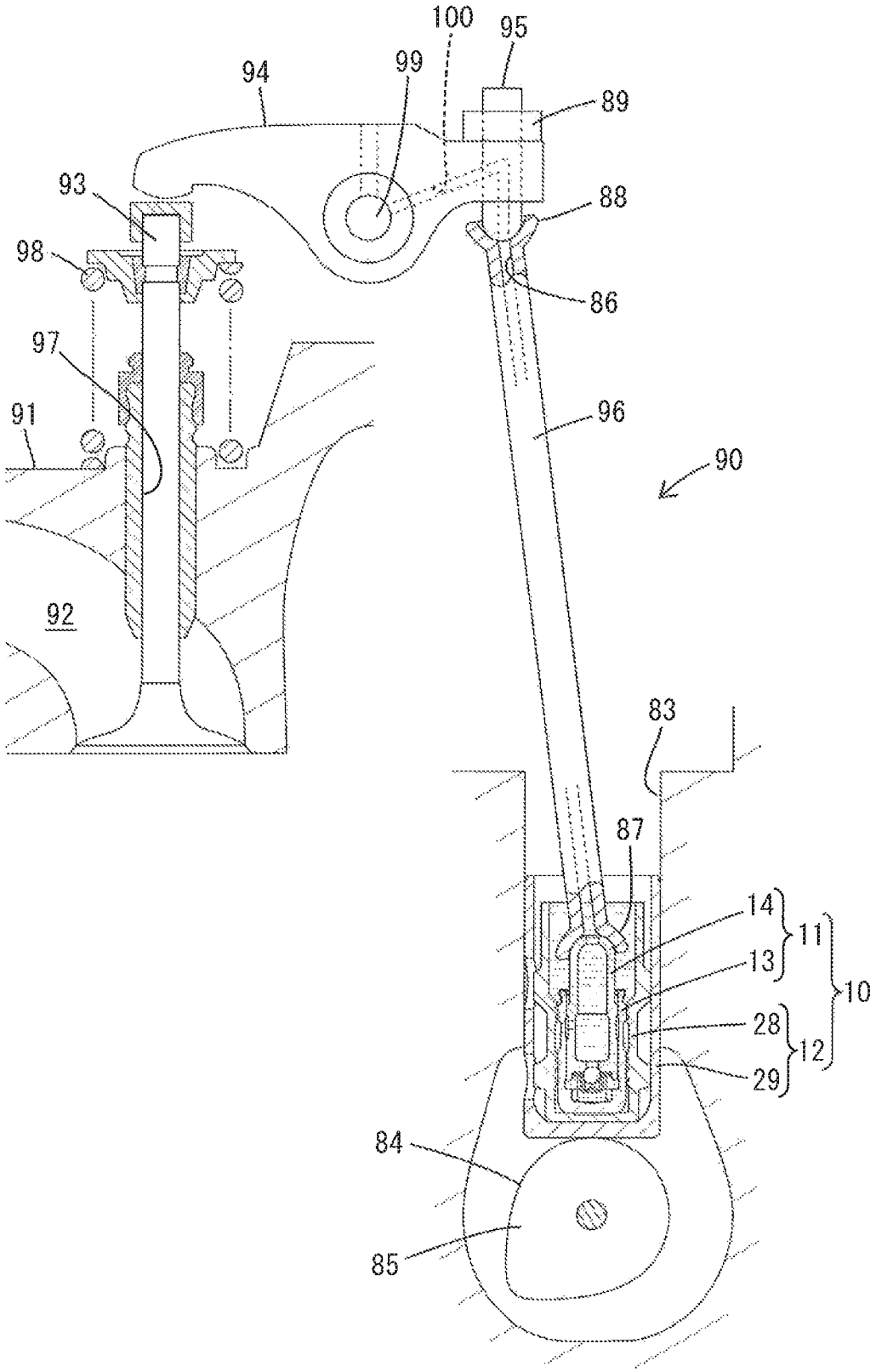
FIG. 1 is an overall view of a valve gear including a tappet according to Embodiment 1 of the present invention.

Preferred embodiments of the present invention are shown below.

The lash adjuster includes: a body which has a body oil hole; and a plunger which has a plunger oil hole and is inserted into the body so as to be reciprocally slidable in the vertical direction, the body oil hole communicating with a low pressure chamber in the plunger through the plunger oil hole. An oil level of the hydraulic oil in the low pressure chamber is located above the body oil hole when the internal combustion engine is stopped. According to such a configuration, air entrainment to a high pressure chamber can be reliably avoided. In the case of the present invention, the lash adjuster is internally fitted to a tappet case, and an air-vent passage is opened upward. Therefore, a sufficient amount of hydraulic oil can be secured in the low pressure chamber as described above.

The tappet case is provided with an oil passage which guides downward hydraulic oil overflowing from the tappet case. According to this, it is possible to secure a predetermined amount of hydraulic oil in the tappet case without trouble.

A lower end of the oil passage is opened at a position where hydraulic oil falling from the oil passage is adherable to a cam surface of the cam. According to this, the cam surface of the cam can be efficiently lubricated by the hydraulic oil having overflowed from an upper portion of the tappet case.

The tappet case includes an inner case having the air-vent passage and an outer case in which the inner case is housed, and the oil passage is formed between the inner case and the outer case. According to this, the tappet case is not unnecessarily thickened, so that weight of a valve gear mechanism can be reduced.

The inner case includes large-diameter portions provided at an interval in the vertical direction, each of the large-diameter portions protruding outward in a radial direction and having a distal end surface in a protruding direction which is capable of abutting against the inner peripheral surface of the outer case. The outer case includes an opening which is provided penetrating therethrough at a height position corresponding to the large-diameter portion and which a part of the large-diameter portion in a circumferential direction faces. According to this, since a small-diameter portion located between the upper and lower large-diameter portions of an outer peripheral surface of the inner case and the opening of the outer case are used as the oil passage, there is no need to form a longitudinal groove structure extending long over the entire length in the vertical direction as the oil passage, so that manufacturing cost can be reduced. Furthermore, when centerless machining is performed, the upper and lower large-diameter portions can be rotatably supported between a grindstone, an adjustment grindstone and a support blade without trouble, so that grinding of the outer peripheral surface of the inner case can be performed smoothly.

The tappet case is provided with a thin portion which is recessed in a direction retracting from an inner peripheral surface of a tappet guide over an entire circumference of the tappet case to define a part of the oil passage in the vertical direction between the inner peripheral surface of the tappet guide and the thin portion. Since the thin portion is provided over the entire circumference of the tappet case, the weight of the valve gear mechanism can be reduced. Furthermore, since a part of the oil passage in the vertical direction is constituted by the thin portion, there is no need to form a longitudinal groove structure extending long over the entire length in the vertical direction as the oil passage, so that manufacturing cost can be reduced.

The lash adjuster has a cylindrical body having a body peripheral wall through which the body oil hole penetrates and the plunger having a plunger peripheral wall through which the plunger oil hole penetrates and which is inserted in the body so as to be reciprocally slidable in a vertical direction, the plunger including the low pressure chamber, the body including a high pressure chamber defined between a lower portion of the body and a bottom wall portion of the plunger, the body oil hole and the plunger oil hole communicating with the low pressure chamber and also communicating, though a gap between the body peripheral wall and the plunger peripheral wall, with the high pressure chamber. The inner peripheral surface of the tappet case has a seal surface formed in a region above the body oil hole and except the air-vent passage, the seal surface being configured to contact the body peripheral wall.

For example, immediately after assembly of the lash adjuster, the hydraulic oil may be stored in the lash adjuster only up to the height of the body oil hole. Thus, if an upper side of the body oil hole is opened to the outside, there is a concern that the hydraulic oil may flow out to the outside by the reciprocating sliding of the plunger relative to the body, and in addition, air may enter the high pressure chamber, so that malfunction of the lash adjuster may be caused.

Thus, according to the above configuration, the seal surface of the tappet case contacts the body peripheral wall above the body oil hole, so that it is maintained in the state where the body oil hole does not communicate with the outside except for the air-vent passage. As a result, at the time of start-up immediately after the lash adjuster is assembled, the hydraulic oil is prevented from flowing out to the outside and air entrainment to the high pressure chamber can be avoided.

The air-vent passage has a concave groove which extends spirally in the vertical direction on the inner peripheral surface of the tappet case. There is a concern that the hydraulic oil in the lash adjuster flows out to the outside through the air-vent passage, but according to the above configuration, the concave groove of the air-vent passage extends spirally on the inner peripheral surface of the tappet case. As a result, the hydraulic oil is less likely to flow in the concave groove and prevented from flowing out to the outside.

Embodiment 1

Embodiment 1 of the present invention will be described with reference to FIGS. 1 to 4. A tappet 10 according to Embodiment 1 is provided in a valve gear 90 of an internal combustion engine, and illustrates a valve lifter of an OHV type engine.

As shown in FIG. 1, the valve gear 90 includes: a valve 93 which is incorporated so as to be able to open and close an intake or exhaust port 92 of a cylinder head 91 and has an upper end portion disposed protruding above the cylinder head 91; a rocker arm 94 having one lengthwise end portion which abuts against the upper end portion of the valve 93; a push rod 96 having an upper end portion which abuts against the other lengthwise end portion of the rocker arm 94 via an adjusting screw 95; a hydraulic lash adjuster 11 against which a lower end portion of the push rod 96 abuts; and a tappet case 12 housing the lash adjuster 11. Among these, the tappet 10 is constituted of the lash adjuster 11 and the tappet case 12.

The valve 93 is inserted through a valve guide 97 so as to be vertically slidable, and is biased in a valve closing direction (a direction for lifting one end portion of the rocker arm 94) by a biasing member 98 such as a coil spring.

The rocker arm 94 is swung with a rocker shaft 99, which penetrates a lengthwise middle portion of the rocker arm 94, serving as a fulcrum, thereby opening and closing the valve 93 based on the swing displacement. The adjusting screw 95 penetrates the other end portion of the rocker arm 94 and is screwed to a nut 89, and an amount of downward protrusion thereof from the other end portion of the rocker arm 94 is adjustable according to screwing into the nut 89.

Figure 2:
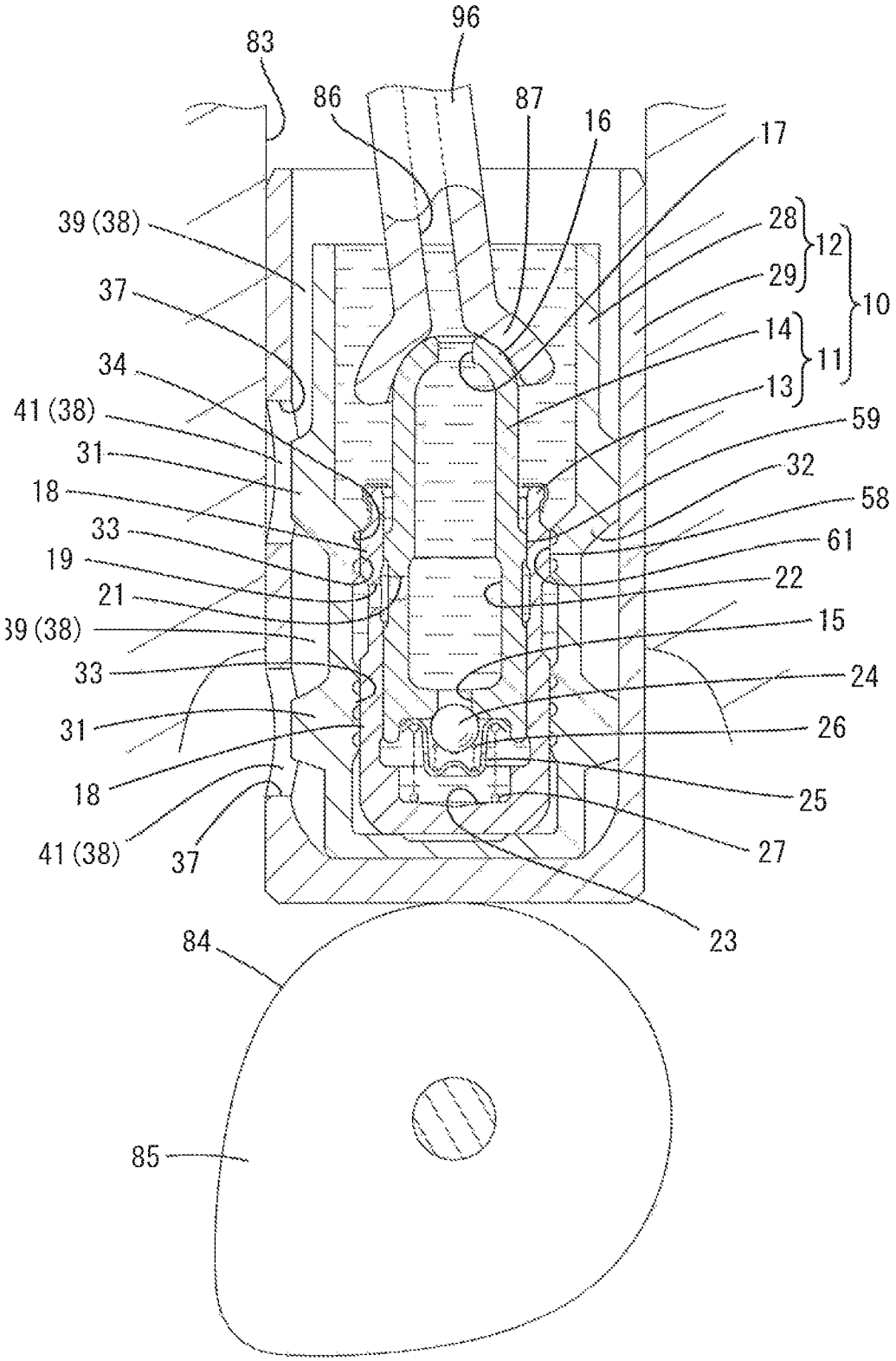
FIG. 2 is a cross-sectional view of a tappet portion in FIG. 1.

The push rod 96 has a rod-like shape elongated vertically, and is housed in a rod housing portion (not shown) so as to be vertically displaceable. The upper end portion of the push rod 96 is a hemispherical upper end recess 88 spread outward and upward. A lower end portion of the adjusting screw 95 is slidably supported on the upper end recess 88. The lower end portion of the push rod 96 is a hemispherical lower end recess 87 spread outward and downward. As shown in FIG. 2, the lower end recess 87 is slidably supported on a top portion 16 of a plunger 14, which will be described later, of the lash adjuster 11.

The push rod 96 is provided with an axial hole 86 which extends to be elongated in the axial direction and has an upper end opened at a central portion of the upper end recess 88 and a lower end opened at a central portion of the lower end recess 87. When hydraulic oil (lubricating oil) is supplied to the rocker arm 94, the supplied hydraulic oil mainly flows from an oil passage 100 in the rocker arm 94 and in the adjusting screw 95 to enter the axial hole 86 through a sliding region of the adjusting screw 95 and the upper end recess 88, descends along the axial hole 86 to reach the lower end recess 87, and is stored in a low pressure chamber 22 through a top hole 17 which will be described later. Furthermore, a part of the hydraulic oil flows down along an outer surface of the push rod 96 from the rocker arm 94 side and enters inside the tappet case 12.

Next, the tappet 10 will be described. First, the lash adjuster 11 constituting the tappet 10 will be described. As shown in FIG. 2, the lash adjuster 11 includes a bottomed cylindrical body 13 and the bottomed cylindrical plunger 14 inserted therein so as to be slidable in the vertical direction of the body 13. The plunger 14 has a valve hole 15 in a bottom wall portion thereof and has the hemispherical top portion 16 at an upper end portion of a peripheral wall portion thereof (plunger peripheral wall 59). The center of the top portion 16 is provided with a top hole 17 penetrating therethrough vertically. In a peripheral wall portion of the body 13 (body peripheral wall 58), upper and lower abutment portions 18 which abut against an inner peripheral surface of an inner case 28 which will be described later are provided over the entire circumference, and a body oil hole 19 penetrating the body peripheral wall 58 is provided so as to be opened at a recessed portion between the abutment portions 18. In the plunger peripheral wall 59 of the plunger 14, a plunger oil hole 21 which communicates with the body oil hole 19 is provided penetrating therethrough.

The inside of the plunger 14 is constituted as the low pressure chamber 22. Inside the body 13, a high pressure chamber 23 is defined between a lower end portion of the body 13 and the bottom wall portion of the plunger 14. Here, the hydraulic oil flows into the low pressure chamber 22 from the axial hole 86 of the push rod 96 through the top hole 17 and also flows into the low pressure chamber 22 from the inside of the inner case 28 which will be described later through an air-vent passage 34, the body oil hole 19 and the plunger oil hole 21, and is stored in the low pressure chamber 22. The hydraulic oil in the high pressure chamber 23 ascends through a gap between the body peripheral wall 58 and the plunger peripheral wall 59, and can enter the recessed portion between the abutment portions 18 from the body oil hole 19, and also can return to the low pressure chamber 22 through the plunger oil hole 21.

The hydraulic oil stored in the low pressure chamber 22 is filled into the high pressure chamber 23 through the valve hole 15. The high pressure chamber 23 houses a spherical valve body 24, a cage-shaped retainer 25, a first spring 26 and a second spring 27. The valve body 24 and the first spring 26 are arranged inside the retainer 25, and the valve body 24 is biased by the first spring 26 in a direction to close the valve hole 15. The retainer 25 is press-fitted into the plunger 14 and abuts against the bottom wall portion of the plunger 14.

The tappet case 12 includes an inner case 28 having bottomed a cylindrical shape and an outer case 29 having a bottomed cylindrical shape which is separated from the inner case 28 and in which the inner case 28 is housed. The peripheral wall of the inner case 28 is formed thin as a whole and has annular rib-shaped large-diameter portions 31 provided at two places spaced from each other in the middle of the vertical direction and protruding radially outward over the entire circumference. A radially outer end surface of the large-diameter portion 31 has a circumferential shape capable of abutting against an inner peripheral surface of the outer case 29 along the circumferential direction. A region excluding the upper and lower large-diameter portions 31 in the outer peripheral surface of the inner case 28 is retracted in a direction away from the inner peripheral surface of the outer case 29 (inward direction). In this region, a region lower than the lower large-diameter portion 31 and a region between the upper and lower large-diameter portions 31 are largely retracted inward due to an inclined portion 32 which will be described later.

Figure 4:
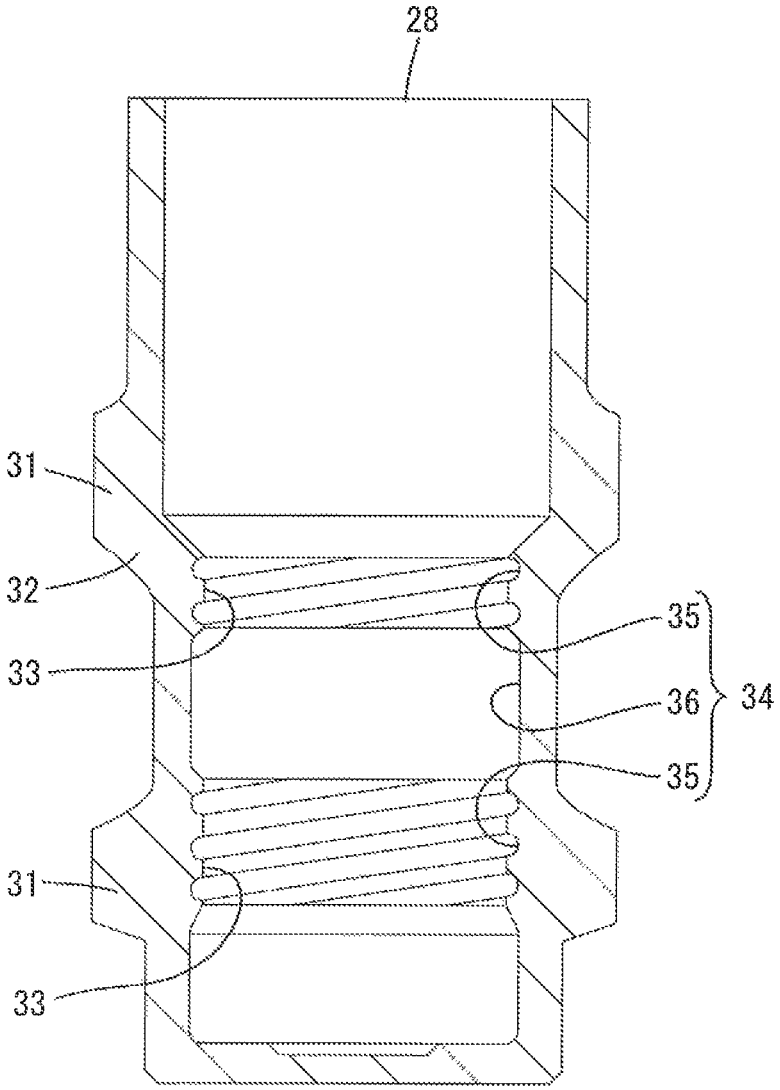
FIG. 4 is a cross-sectional view of an inner case.

In the peripheral wall of the inner case 28, the inclined portion 32 having a diameter reduced downward is provided at a portion of a height position corresponding to the upper large-diameter portion 31. As shown in FIG. 4, in upper and lower regions of the inner peripheral surface of the inner case 28 bordering the inclined portion 32, the lower region has a smaller diameter than the upper region. Inside the inner case 28, the lash adjuster 11 is inserted from above in a closely fitted state. In the lower region of the inner peripheral surface of the inner case 28, a pair of upper and lower inner annular portions 33 capable of abutting against the abutment portions 18 of the body 13 is provided over the entire circumference.

The air-vent passage 34 is provided on the inner peripheral surface of the inner case 28. Specifically, the air-vent passage 34 is constituted by: a concave groove 35 which is engraved in the upper and lower inner annular portions 33 in the inner peripheral surface of the inner case 28 and extends so as to be spirally wound in the vertical direction in the lower region as a whole; and a recess 36 having a form retracted over the entire circumference in a direction away from the outer peripheral surface of the body peripheral wall 58 of the body 13. In the air-vent passage 34, an upper end of the concave groove 35 is opened at a slope portion of the inclined portion 32, whereas lower end is closed by a bottom wall of the inner case 28. Since the concave groove 35 has a form wound spirally, an inner peripheral surface of the inner case 28 can be polished smoothly.

As shown in FIG. 2, a bottom wall of the outer case 29 has a flat lower surface portion which slidingly contacts a cam surface 84 of a rotating cam 85. A peripheral wall of the outer case 29 is in a thin-walled form in which inner and outer peripheral surfaces are both arranged almost along the vertical direction, and the upper end of the peripheral wall is located above an upper end of the inner case 28 to be inserted therein. The outer peripheral surface of the outer case 29 is configured to slidingly contact along an inner peripheral surface of a tappet guide 83.

Figure 3:
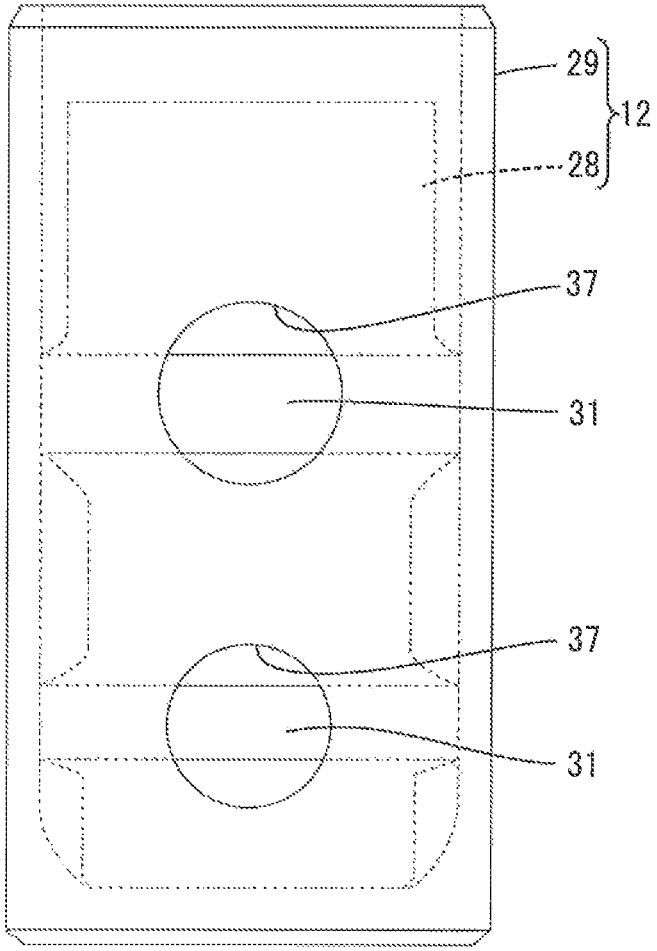
FIG. 3 is a side view of a tappet case.

As shown in FIGS. 2 and 3, in the peripheral wall of the outer case 29, a pair of upper and lower circular openings 37 are provided penetrating therethrough at a height position corresponding to the upper and lower large-diameter portions 31 of the inner case 28 to be inserted therein. The upper and lower large-diameter portions 31 are each arranged such that a part thereof in the circumferential direction faces the opening 37.

Here, the hydraulic oil falls from the rocker arm 94 side and is stored inside the inner case 28. As shown in FIG. 2, an oil passage 38 for guiding downward the hydraulic oil overflowing from the upper end of the inner case 28 is formed between the inner case 28 and the outer case 29. The oil passage 38 is constituted by: an inter-wall passage 39 having a passage width or diameter determined by the large-diameter portion 31 between an outer peripheral wall of the inner case 28 and an inner peripheral wall of the outer case 29; and a bypass passage 41 located in the upper and lower openings 37 and between the tappet guide 83 and the large-diameter portions 31. An outlet of the oil passage 38 is constituted by an opening portion of the lower bypass passage 41 and disposed at a position facing the cam surface 84 of the cam 85 from above.

Next, the operation of the tappet 10 according to Embodiment 1 will be described.

At the time of assembly, the lash adjuster 11 is inserted into the inner case 28 of the tappet case 12 from above. At this time, there is a concern that the abutment portion 18 of the body 13 and the inner annular portion 33 of the inner case 28 abut against each other so that air between the body 13 and a lower end portion of the inner case 28 is enclosed. However, the air ascends in the air-vent passage 34 and is discharged upward, whereby the lash adjuster 11 is housed in the tappet case 12 without trouble. In a state where the lash adjuster 11 is properly housed in the inner case 28, the upper end of the inner case 28 is located above an upper end of the plunger 14.

Next, a valve gear mechanism will be described. When the cam 85 rotates, the outer case 29 in contact with the cam 85 is slidingly displaced in the tappet guide 83 in the vertical direction. In accordance therewith, the push rod 96 is raised and lowered in the rod housing portion via the lash adjuster 11. The rising and lowering operation of the push rod 96 is transmitted to the rocker arm 94 via the adjusting screw 95, whereby the rocker arm 94 is swung and displaced with the upper end recess 88 of the push rod 96 serving as an approximate fulcrum, so that the valve 93 is opened and closed.

By the way, when downward pressure is applied to the plunger 14 from the push rod 96 side according to the driving of the cam 85, the valve body 24 closes the valve hole 15, and the plunger 14 and the body 13 are turned into a rigid body, so that lowering of the plunger 14 is restricted. When the pressure applied to the plunger 14 is reduced, the plunger 14 is biased by the second spring 27 and the valve body 24 opens the valve hole 15, so that the hydraulic oil in the low pressure chamber 22 is transferred to the high pressure chamber 23. Thus, lift force of the cam 85 is attenuated and transmitted to the push rod 96 and the rocker arm 94 via the lash adjuster 11. While the tappet case 12 moved vertically, the lower bypass passage 41 is located below the tappet guide 83, and the hydraulic oil overflowing from the upper end of the inner case 28 passes through the oil passage 38 and is discharged from the lower bypass passage 41 to the cam 85 side.

The low pressure chamber 22 of the lash adjuster 11 communicates with the inside of the inner case 28 via the plunger oil hole 21 and the body oil hole 19. Though the air-vent passage 34 is provided on the inner peripheral surface of the inner case 28, the air-vent passage 34 is opened at the slope portion of the inclined portion 32 and the inside of the inner case 28 is opened only upward as a whole. Therefore, when an internal combustion engine is stopped for a long period of time, the hydraulic oil is stored in the inner case 28 substantially up to the upper end of the inner case 28, and via the inner case 28, the hydraulic oil is also stored in the lash adjuster 11 in almost the entire low pressure chamber 22.

As described above, while the internal combustion engine is stopped, the hydraulic oil is not discharged from the low pressure chamber 22 to the outside through the air-vent passage 34 of the tappet case 12, and the state where the hydraulic oil is stored in the low pressure chamber 22 is maintained. Therefore, when the valve hole 15 is opened at the time of restart later, substantially only the hydraulic oil is transferred from the low pressure chamber 22 to the high pressure chamber 23, so that air entrainment in the high pressure chamber 23 can be avoided.

Furthermore, as the tappet case 12 moves vertically at the time of restart, the hydraulic oil stored in the inner case 28 overflows from the upper end of the inner case 28 and enters the oil passage 38. The hydraulic oil having entered the oil passage 38 falls downward through the inter-wall passage 39 and the bypass passage 41, and adheres to the cam surface 84 of the cam 85 to lubricate a sliding region between the cam 85 and the tappet case 12. Since the hydraulic oil in the inner case 28 is used as a lubricating means for the cam 85, the sliding region between the cam 85 and the tappet case 12 can be quickly lubricated after restart.

As described above, according to Embodiment 1, when the lash adjuster 11 is incorporated into the tappet case 12, the air existing between the tappet case 12 and the lash adjuster 11 is discharged upward through the air-vent passage 34, so that assembling performance of the lash adjuster 11 can be improved.

Furthermore, since the air-vent passage 34 is opened upward (in detail, obliquely upward), the hydraulic oil stored in the low pressure chamber 22 of the lash adjuster 11 can be prevented from leaking through the air-vent passage 34 when the internal combustion engine is stopped for a long period of time. As a result, it is possible to avoid air entrainment to the high pressure chamber 23 at the time of restart, and the function of the lash adjuster 11 can be properly exhibited. In particular, since the oil level of the hydraulic oil in the low pressure chamber 22 of the lash adjuster 11 is located above at least the body oil hole 19 when the internal combustion engine is stopped for a long period of time, the air entrainment to the high pressure chamber 23 can be reliably avoided.

Furthermore, since the tappet case 12 is provided with the oil passage 38 which guides downward the hydraulic oil overflowing from the tappet case 12, it is possible to secure a predetermined amount of hydraulic oil in the tappet case 12 without trouble. In addition, since a lower end of the oil passage 38 is opened at a position where the hydraulic oil falling from the oil passage 38 is adherable to the cam surface 84 of the cam 85, the cam surface 84 of the cam 85 can be efficiently and quickly lubricated.

Furthermore, the tappet case 12 includes the inner case 28 having the air-vent passage 34 and the outer case 29 in which the inner case 28 is housed, and the oil passage 38 is formed between the inner case 28 and the outer case 29. Therefore, the tappet case 12 is not unnecessarily thickened, so that the weight of the valve gear mechanism can be reduced.

Furthermore, the inner case 28 includes the pair of large-diameter portions 31 provided at an interval in the vertical direction, each of the large-diameter portions 31 protruding outward in the radial direction and having a distal end surface in the protruding direction which is capable of abutting against the inner peripheral surface of the outer case 29. The outer case 29 includes the opening 37 which is provided penetrating therethrough at the height position corresponding to the large-diameter portion 31 and which a part of the large-diameter portion 31 in the circumferential direction faces. Therefore, when centerless machining is performed for the inner case 28, the upper and lower large-diameter portions 31 can be rotatably supported between a grindstone, an adjustment grindstone and a support blade without trouble, so that grinding of the outer peripheral surface of the inner case 28 can be performed smoothly. In addition, since the small-diameter portion located between the upper and lower large-diameter portions 31 of the outer peripheral surface of the inner case 28 and the openings 37 of the outer case 29 are used as the oil passage 38, there is no need to form a longitudinal groove extending long over the entire length in the vertical direction as the oil passage 38, so that manufacturing cost can be reduced.

Embodiment 2

Figure 5:
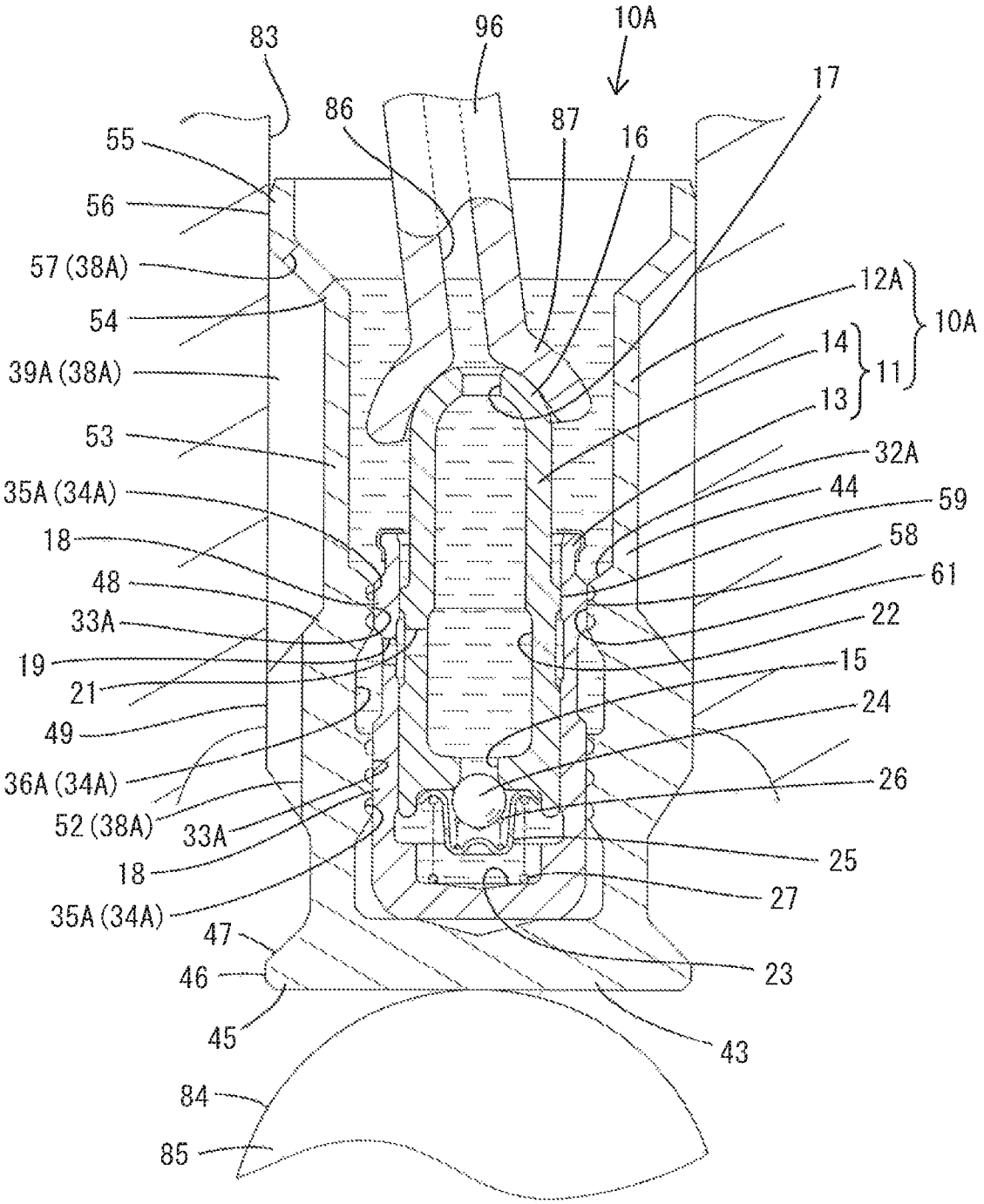
FIG. 5 is a view corresponding to FIG. 2, showing a tappet according to Embodiment 2 of the present invention.
Figure 6:
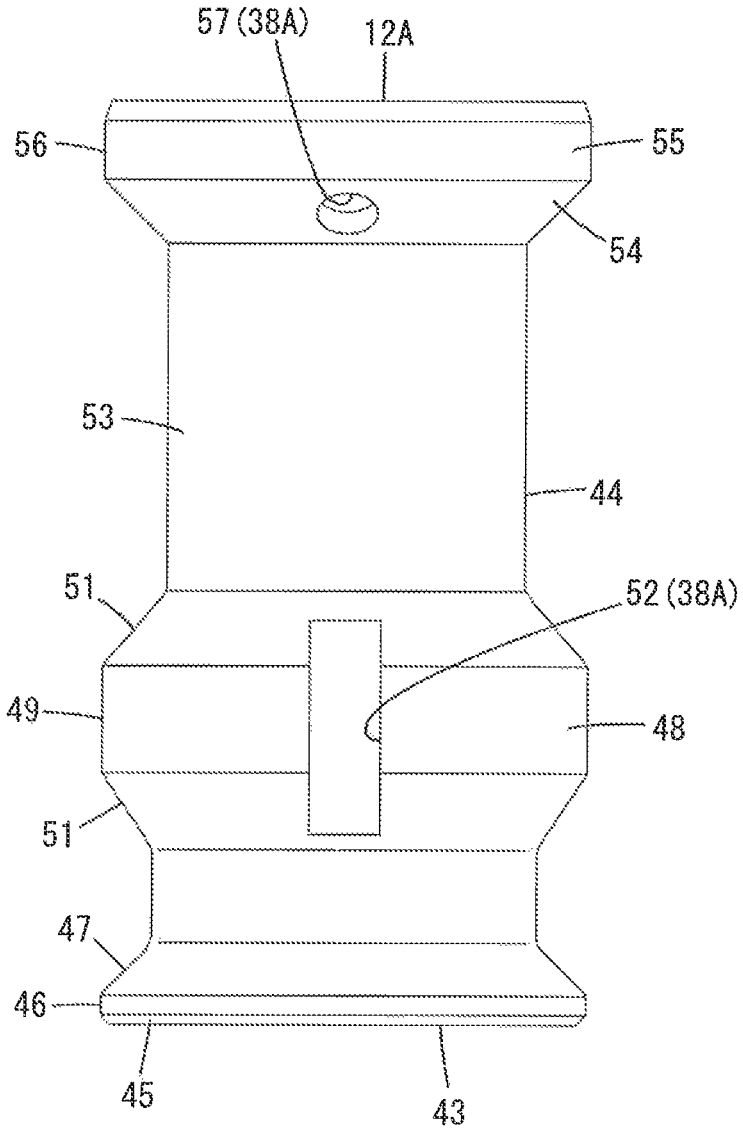
FIG. 6 is a side view of a tappet case.
Figure 7:
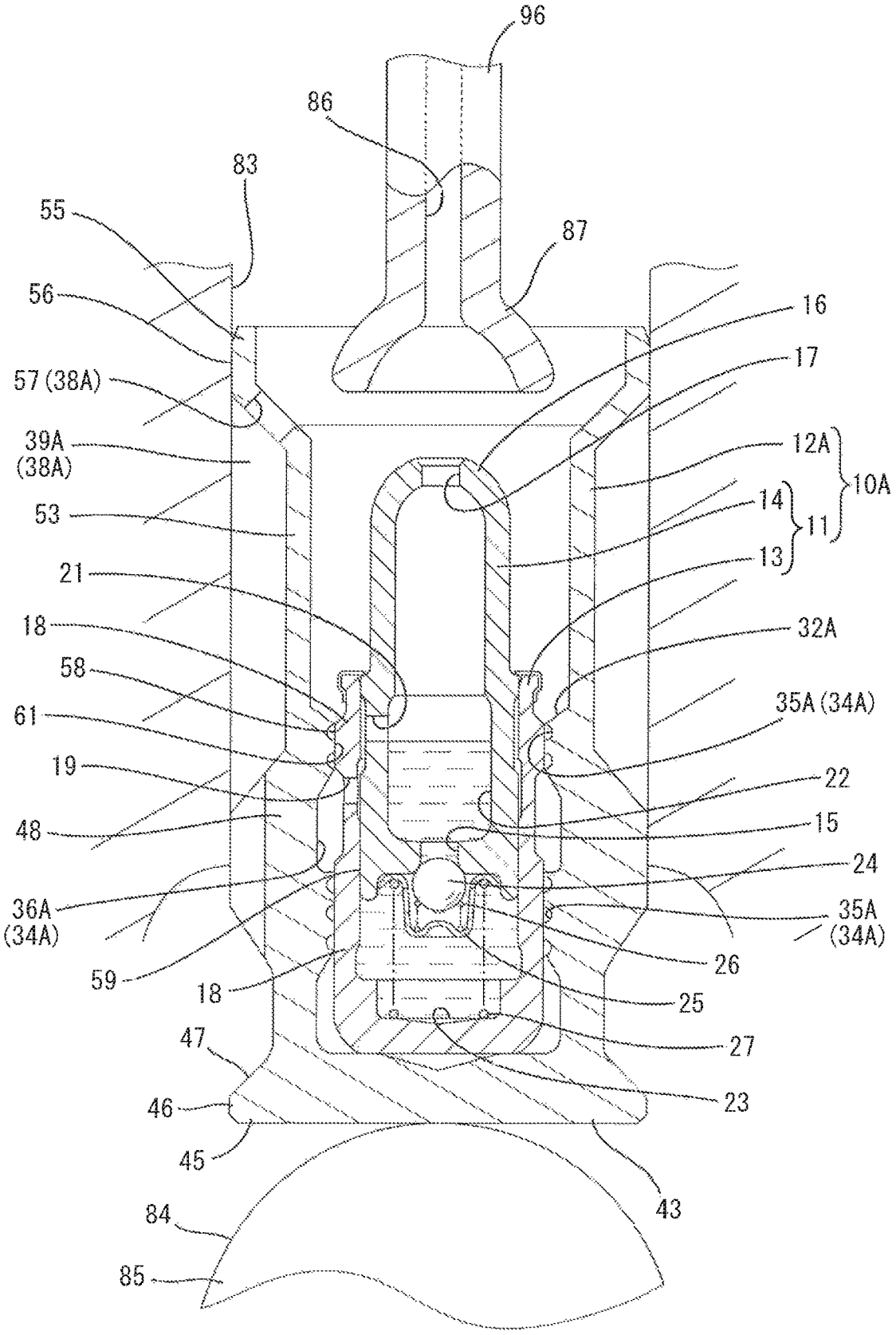
FIG. 7 is a cross-sectional view of a state immediately after a lash adjuster is assembled to the tappet case.

FIGS. 5 to 7 show a tappet 10A according to Embodiment 2 of the present invention. In the tappet 10A of Embodiment 2, a tappet case 12A is integrally formed in its entirety, and the form thereof is different from that of Embodiment 1. However, a lash adjuster 11 is internally fitted to the tappet case 12A, and the structure other than the tappet case 12A is the same as that of Embodiment 1. Therefore, in Embodiment 2, the components similar to those of Embodiment 1 are labeled by the same reference symbols as those in Embodiment 1, and duplicate explanations will be omitted.

The tappet case 12A includes a relatively thick disk-like bottom wall portion 43 and a cylindrical peripheral wall portion 44 rising from an outer periphery of the bottom wall portion 43. The bottom wall portion 43 has a flat lower surface portion which slidingly contacts a cam surface 84 of a rotating cam 85. An outer peripheral edge portion of the bottom wall portion 43 is formed as an expanded portion 45 which protrudes radially outward over the entire circumference. An outer peripheral surface of the expanded portion 45 is constituted by a circulating plane 46 in a circumferential shape and a lower end inclined surface 47 in a tapered shape having a diameter reduced upward from an upper end of the circulating plane 46.

The peripheral wall portion 44 has a lower sliding contact portion 48 in the middle in the vertical direction, and the lower sliding contact portion 48 is formed thicker than regions on both upper and lower sides thereof. An outer peripheral surface of the lower sliding contact portion 48 is constituted by: a lower sliding contact surface 49 having a circumferential shape and capable of slidingly contacting an inner peripheral surface of a tappet guide 83; and upper and lower inclined surfaces 51 in a tapered shape having the respective diameters reduced toward upper and lower sides from the lower sliding contact surface 49. The lower sliding contact surface 49 of the lower sliding contact portion 48 is provided with a recessed groove 52 formed in a cut-out shape which extends vertically and has both upper and lower ends opened at the upper and lower inclined surfaces 51.

The region above the lower sliding contact portion 48 in the peripheral wall portion 44 is a thin portion 53 which is recessed over the entire circumference in a direction retracting from the inner peripheral surface of the tappet guide 83. The thin portion 53 is formed along the vertical direction and is formed the thinnest in the tappet case 12A together with an upper sliding contact portion 55 which will be described later.

An upper end portion of the peripheral wall portion 44 includes: an enlarged diameter portion 54 in a tapered shape having a diameter increased upward from an upper end of the thin portion 53; and the cylindrical upper sliding contact portion 55 rising substantially upright from an upper end of the enlarged diameter portion 54, and is provided continuously with the thin portion 53 with almost the same thickness as the thin portion 53.

An outer peripheral surface of the upper sliding contact portion 55 is an upper sliding contact surface 56 in a circumferential shape which is capable of slidingly contacting the inner peripheral surface of the tappet guide 83. The upper sliding contact surface 56 is disposed at substantially the same position as the sliding contact surface 49 of the lower sliding contact portion 48 and the circulating plane 46 of the expanded portion 45 with respect to the radial direction. When centerless machining is performed for the tappet case 12A, since the upper sliding contact portion 55 and the expanded portion 45 can be rotationally supported between a grindstone, an adjustment grindstone and a support blade, grinding of the outer peripheral surface of the tappet case 12A can be performed smoothly.

In the enlarged diameter portion 54, a circular through hole 57 is provided penetrating therethrough in the thickness direction at almost the same position as the recessed groove 52 in the circumferential direction. Here, hydraulic oil stored inside the tappet case 12A is discharged downward through an oil passage 38A. The oil passage 38A is constituted by the through hole 57, an inter-wall passage 39A defined between an outer peripheral surface of the thin portion 53 and the inner peripheral surface of the tappet guide 83, and the recessed groove 52. A part of the hydraulic oil descends from the through hole 57 along the oil passage 38A, then is temporarily received by a lower end inclined surface 47, and then falls from the lower end inclined surface 47 toward the cam surface 84 side of the cam 85.

The lash adjuster 11 is inserted into the tappet case 12A from above in a closely fitted state. A pair of upper and lower inner annular portions 33A capable of abutting against the abutment portions 18 of the body 13 of the lash adjuster 11 is provided on an inner peripheral surface of the tappet case 12A over the entire circumference.

An air-vent passage 34A is provided on the inner peripheral surface of the tappet case 12A. Specifically, the air-vent passage 34A is constituted by: a concave groove 35A which is engraved in the upper and lower inner annular portions 33A in the inner peripheral surface of the tappet case 12A and extends so as to be spirally wound in the vertical direction as a whole; and a recess 36A having a form retracted over the entire circumference between the upper and lower inner annular portions 33A in a direction away from the outer peripheral surface of the body peripheral wall 58 of the body 13. The upper end of the air-vent passage 34A is opened at a slope portion of the inclined portion 32A, whereas the lower end thereof is closed by a bottom portion of the tappet case 12A. Accordingly, the inner peripheral surface of the tappet case 12A has substantially the same structure as the inner peripheral surface of the inner case 28 of Embodiment 1.

Furthermore, the upper inner annular portion 33A in the inner peripheral surface of the tappet case 12A is provided with a seal surface 61. In a state where the lash adjuster 11 is assembled to the tappet case 12A, the seal surface 61 is located above a body oil hole 19 of the lash adjuster 11 and is in contact with the abutment portion 18 of the body peripheral wall 58 along the circumferential direction. The seal surface 61 is provided over the entire area of the upper inner annular portion 33A except the air-vent passage 34A. The seal surface 61 is similarly provided on the upper inner annular portion 33 in the inner case 28 of the tappet case 12 of Embodiment 1 (see FIG. 2).

As shown in FIG. 7, immediately after the lash adjuster 11 is assembled to the tappet case 12A, there are some cases where the top portion 16 side of the plunger 14 largely projects above the body 13 and the hydraulic oil is not supplied in the tappet case 12A and is stored only up to the height of a plunger oil hole 21.

In that state, when the push rod 96 is supported by the top portion 16 of the plunger 14 and the plunger 14 is lowered to rotate the cam 85, the plunger 14 may reciprocally slide vertically with respect to the body 13 even though the hydraulic oil is not supplied from an axial hole 86 of the push rod 96 to a low pressure chamber 22.

For example, when the plunger 14 is lowered relative to the body 13, the hydraulic oil in the high pressure chamber 23 may ascends through a gap between the body peripheral wall 58 and the plunger peripheral wall 59 and may enter a recessed portion between the abutment portions 18 through the body oil hole 19. At this time, if the upper side of the body oil hole 19 is largely opened to the outside, there is a concern that the hydraulic oil which has entered the recessed portion between the abutment portions 18 may flow out to the outside.

However, according to the above configuration, since a gap between an upper portion of the tappet case 12A (upper inner annular portion 33A) and the body peripheral wall 58 is closed in a fluid-tight manner by the seal surface 61 except for the air-vent passage 34A, the hydraulic oil is returned from the recessed portion between the abutment portions 18 to the low pressure chamber 22 through the plunger oil hole 21, or maintained staying in the low pressure chamber 22 and the high pressure chamber 23. Accordingly, at the time of start-up immediately after the lash adjuster 11 is assembled, the hydraulic oil is prevented from flowing out to the outside of the lash adjuster 11 by the seal surface 61, and consequently, air entrainment to the high pressure chamber 23 is avoided.

Furthermore, since the air-vent passage 34A provided in the upper and lower inner annular portions 33A is the concave groove 35A extending spirally, the hydraulic oil is less likely to move in the concave groove 35A and can suitably stay in the low pressure chamber 22 and the high pressure chamber 23. In particular, above the body oil hole 19, since the spiral concave groove 35A is disposed together with the seal surface 61, the hydraulic oil is less likely to flow above the body oil hole 19 and preferentially returned from the body oil hole 19 side toward the low pressure chamber 22 side through the plunger oil hole 21. As a result, a predetermined amount of the hydraulic oil can be stored in the low pressure chamber 22 of the lash adjuster 11, so that the air entrainment to the high pressure chamber 23 can be more reliably avoided.

Furthermore, according to Embodiment 2, since the air-vent passage 34A is opened upward as in Embodiment 1, the hydraulic oil stored in the low pressure chamber 22 of the lash adjuster 11 can be prevented from leaking to the outside through the air-vent passage 34 when an internal combustion engine is stopped for a long period of time.

Furthermore, when the internal combustion engine is stopped for a long period of time, the hydraulic oil is stored in the tappet case 12A up to a height position regulated by the through hole 57 and the hydraulic oil is stored in the entire low pressure chamber 22 of the lash adjuster 11. Therefore, the air entrainment to the high pressure chamber 23 can be reliably avoided.

Furthermore, the tappet case 12A is provided with the thin portion 53 which is recessed in the direction retracting from the inner peripheral surface of the tappet guide 83 over the entire circumference to define the inter-wall passage 39A of the oil passage 38A between the inner peripheral surface of the tappet guide 83 and the thin portion 53. Therefore, there is no need to form a longitudinal groove structure extending long over the entire length in the vertical direction of the tappet case 12A as the oil passage 38A, so that cost can be reduced.

OTHER EMBODIMENTS

Other embodiments will be briefly described below.

(1) An air-vent passage may extend on an inner peripheral surface of a tappet case almost along the vertical direction.

(2) The air-vent passage may extend on the inner peripheral surface of the tappet case continuously without interruption in the vertical direction.

(3) A plurality of the air-vent passages may be provided on the inner peripheral surface of the tappet case at intervals in the circumferential direction.

(4) Almost the entire outer peripheral surface of the tappet case may be formed to be slidable on the inner peripheral surface of a tappet guide.

(5) An oil passage may be a longitudinal groove extending on the outer peripheral surface of the tappet case over the entire length in the vertical direction.

REFERENCE SIGNS LIST

10, 10A . . . tappet
11 . . . lash adjuster
12, 12A . . . tappet case
13 . . . body
14 . . . plunger
19 . . . body oil hole
21 . . . plunger oil hole
22 . . . low pressure chamber
28 . . . inner case
29 . . . outer case
31 . . . large-diameter portion
34 . . . air-vent passage
37 . . . opening
38 . . . oil passage
53 . . . thin portion
61 . . . seal surface
83 . . . tappet guide
84 . . . cam surface
85 . . . cam
90 . . . valve gear
96 . . . push rod

The invention claimed is:

1. A tappet comprising:

a hydraulic lash adjuster which supports a lower end portion of a push rod; and a tappet case to which the lash adjuster is internally fitted and which is reciprocally displaced in a vertical direction according to a rotating cam, wherein an inner peripheral surface of the tappet case is provided with an air-vent passage through which air existing between the tappet case and the lash adjuster is discharged upward when the lash adjuster is being assembled.

2. The tappet according to claim 1, wherein the lash adjuster includes: a body which has a body oil hole; and a plunger which has a plunger oil hole and is inserted into the body so as to be reciprocally slidable in the vertical direction, the body oil hole communicating with a low pressure chamber in the plunger through the plunger oil hole, and an oil level of hydraulic oil in the low pressure chamber is located above the body oil hole when an internal combustion engine is stopped.

3. The tappet according to claim 1, wherein the tappet case is provided with an oil passage which guides downward hydraulic oil overflowing from the tappet case.

4. The tappet according to claim 3, wherein a lower end of the oil passage is opened at a position where hydraulic oil falling from the oil passage is adherable to a cam surface of the cam.

5. The tappet according to claim 3, wherein the tappet case includes an inner case having the air-vent passage and an outer case in which the inner case is housed, and the oil passage is formed between the inner case and the outer case.

6. The tappet according to claim 5, wherein the inner case includes large-diameter portions provided at an interval in the vertical direction, each of the large-diameter portions protruding outward in a radial direction and having a distal end surface in a protruding direction which is capable of abutting against an inner peripheral surface of the outer case, and the outer case includes an opening which is provided penetrating therethrough at a height position corresponding to the large-diameter portion and which a part of the large-diameter portion in a circumferential direction faces.

7. The tappet according to claim 3, wherein the tappet case is provided with a thin portion which is recessed in a direction retracting from an inner peripheral surface of a tappet guide over an entire circumference of the tappet case to define the oil passage in the vertical direction between the inner peripheral surface of the tappet guide and the thin portion.

8. The tappet according to claim 1, wherein the lash adjuster has a cylindrical body having a body peripheral wall through which the body oil hole penetrates and a plunger having a plunger peripheral wall through which the plunger oil hole penetrates and which is inserted in the body so as to be reciprocally slidable in a vertical direction, the plunger including a low pressure chamber, the body including a high pressure chamber defined between a lower portion of the body and a bottom wall portion of the plunger, the body oil hole and the plunger oil hole communicating with the low pressure chamber and also communicating, through a gap between the body peripheral wall and the plunger peripheral wall, with the high pressure chamber, and the inner peripheral surface of the tappet case has a seal surface formed in a region above the body oil hole and except the air-vent passage, the seal surface being configured to contact the body peripheral wall.

9. The tappet according to claim 1, wherein the air-vent passage has a concave groove which extends spirally in the vertical direction on the inner peripheral surface of the tappet case.

10. The tappet according to claim 2, wherein the tappet case is provided with an oil passage which guides downward hydraulic oil overflowing from the tappet case.

11. The tappet according to claim 2, wherein the lash adjuster has a cylindrical body having a body peripheral wall through which the body oil hole penetrates and a plunger having a plunger peripheral wall through which the plunger oil hole penetrates and which is inserted in the body so as to be reciprocally slidable in a vertical direction, the plunger including a low pressure chamber, the body including a high pressure chamber defined between a lower portion of the body and a bottom wall portion of the plunger, the body oil hole and the plunger oil hole communicating with the low pressure chamber and also communicating, through a gap between the body peripheral wall and the plunger peripheral wall, with the high pressure chamber, and the inner peripheral surface of the tappet case has a seal surface formed in a region above the body oil hole and except the air-vent passage, the seal surface being configured to contact the body peripheral wall.

12. The tappet according to claim 3, wherein the lash adjuster has a cylindrical body having a body peripheral wall through which the body oil hole penetrates and a plunger having a plunger peripheral wall through which the plunger oil hole penetrates and which is inserted in the body so as to be reciprocally slidable in a vertical direction, the plunger including a low pressure chamber, the body including a high pressure chamber defined between a lower portion of the body and a bottom wall portion of the plunger, the body oil hole and the plunger oil hole communicating with the low pressure chamber and also communicating, through a gap between the body peripheral wall and the plunger peripheral wall, with the high pressure chamber, and the inner peripheral surface of the tappet case has a seal surface formed in a region above the body oil hole and except the air-vent passage, the seal surface being configured to contact the body peripheral wall.

13. The tappet according to claim 2, wherein the air-vent passage has a concave groove which extends spirally in the vertical direction on the inner peripheral surface of the tappet case.

14. The tappet according to claim 3, wherein the air-vent passage has a concave groove which extends spirally in the vertical direction on the inner peripheral surface of the tappet case.

15. The tappet according to claim 8, wherein the air-vent passage has a concave groove which extends spirally in the vertical direction on the inner peripheral surface of the tappet case.

16. The tappet according to claim 10, wherein a lower end of the oil passage is opened at a position where hydraulic oil falling from the oil passage is adherable to a cam surface of the cam.

17. The tappet according to claim 10, wherein the tappet case includes an inner case having the air-vent passage and an outer case in which the inner case is housed, and the oil passage is formed between the inner case and the outer case.

18. The tappet according to claim 4, wherein the tappet case includes an inner case having the air-vent passage and an outer case in which the inner case is housed, and the oil passage is formed between the inner case and the outer case.

19. The tappet according to claim 10, wherein the tappet case is provided with a thin portion which is recessed in a direction retracting from an inner peripheral surface of a tappet guide over an entire circumference of the tappet case to define the oil passage in the vertical direction between the inner peripheral surface of the tappet guide and the thin portion.

20. The tappet according to claim 4, wherein the tappet case is provided with a thin portion which is recessed in a direction retracting from an inner peripheral surface of a tappet guide over an entire circumference of the tappet case to define the oil passage in the vertical direction between the inner peripheral surface of the tappet guide and the thin portion.

* * * * *